US005101646A

United States Patent [19]

Goldman et al.

[11] Patent Number: 5,101,646

[45] Date of Patent: Apr. 7, 1992

[54] TAMPER-RESISTANT LOCK

[76] Inventors: David S. Goldman, 20 Fruit St., Hopkinton, Mass. 01748; Craig L. Krigsman, 99 Stillman Ave., Bergenfield, N.J. 07621

[21] Appl. No.: 666,856

[22] Filed: Mar. 7, 1991

[51] Int. Cl.[5] ..... E05B 67/22

[52] U.S. Cl. ..... 70/38 A; 70/39; 70/53

[58] Field of Search ..... 70/39, 26, 53, 38 R, 70/38 A, 38 B, 38 C

[56] References Cited

U.S. PATENT DOCUMENTS 1,616,449 2/1927 Horak ..... 70/53

FOREIGN PATENT DOCUMENTS 2706302 8/1978 Fed. Rep. of Germany ..... 70/39

11362 of 1886 United Kingdom ..... 70/39

*Primary Examiner*—Renee S. Luebke

*Assistant Examiner*—Suzanne L. Dino

*Attorney, Agent, or Firm*—Weingarten, Schurgin, Gagnebin & Hayes

[57] ABSTRACT

The invention provides a lock having a thick U-shaped shackle, a transverse housing for receivably locking extending ends of the shackle, a pair of longitudinal members which lockably intersect the shackle ends and which are actuated by a lock protected within the intermediate portion of the housing. In an exemplary embodiment of the invention, the shackle and housing are constructed of substantially thick tubular metal, and the shackle ends may be conformed to openings in the housing. The longitudinal members may be extended post members which intersect inserted shackle ends or may be forked members which slidably engage flat portions on inserted shackle ends. The locking mechanism may be activated through a rack-and-pinion, cam-and-pin, or similar assembly, and may further comprise shackle ends having flat sections conformed to the housing openings to prevent rotation. The compact and integral design affords improved resistance to tampering such as by shattering or cutting/twisting methods.

14 Claims, 3 Drawing Sheets

TAMPER-RESISTANT LOCK

FIELD OF THE INVENTION

The invention relates to the field of locks, and more particularly to locks of the type used for bicycles and motorcycles.

BACKGROUND OF THE INVENTION

Locks having relatively large U-shaped brackets or shackles in combination with elongated housings have been used for preventing tampering and thwarting bicycle/motorcycle thieves. Early versions of U-shaped locks, such as the kind exemplified in U.S. Pat. Nos. 3,754,418, 3,924,426, and 3,967,475, were fabricated from flat pieces. These were susceptible to cutting by long-armed cutters. Later versions, such as those exemplified in U.S. Pat. Nos. 4,155,231, 4,545,224, and 4,918,949, were fabricated in a tubular shape for added resistance against cutting.

The U-shaped lock design nevertheless remains susceptible to tampering. One manner of tampering has been to cut the U-shaped bracket and wobble and twist the severed pieces of the bracket to loosen the ends of the bracket held in the housing. In each of the tubular designs cited in the patents above, at least one end of the U-shaped shackle is removeably attached to the housing by either a detente or a bent hook end which, after the shackle is cut, can be wiggled within the housing and thus out of the grasp of the detente or hook. Consequently, the cut pieces of the shackle can be pried apart and the lock defeated.

Another way of defeating the lock is to spray the housing with freon to render the metal brittle, and then to shatter the metal of the housing and pry apart the ends of the U-shaped bracket. In many of the tubular lock designs in the patents mentioned, a lock or detente mechanism is located at the end of the housing where it is vulnerable to shattering and otherwise exposed to having leverage applied to pry the lock apart.

U.S. Pat. No. 4,584,855 teaches a U-shaped lock in which a cylinder lock is located within the housing between the openings which lockably receive the shackle ends. However, the lock requires an access port to permit the key to be inserted into the lock, thereby disrupting the structural integrity of the housing. The disclosed detente cavities or gaps in the shackle ends inserted into the housing, like locks of the above-mentioned prior art patents, do not substantially resist defeat of the lock by cutting and twisting. Furthermore, the lock requires numerous internal moving parts.

A U-shaped lock is thus needed for defeating breakage by shattering and for resisting tampering by cutting and twisting.

SUMMARY OF THE INVENTION

In surmounting the disadvantages of prior art U-shaped locks, the invention provides a U-shaped lock having a generally tubular shackle and housing in which a lock mechanism, protected within a thick protective housing and located between the shackle receptacle openings, activates a pair of longitudinal members which engage a shackle end inserted into the housing. The members may also be formed in the shape of posts which intersect the diameter of the inserted shackle ends or forks which slidably engage with flat grooves on the shackle ends.

The locking mechanism may comprise a rack-and-pinion assembly, cam-and-pin assembly, or similar assembly which provides simultaneous engagement of both shackle ends within the protection of the housing. The shackle ends inserted into the housing openings may contain flat portions to provide further resistance against twisting of a cut shackle.

The construction of the housing requires relatively few parts and yet affords a substantial improvement in structural integrity and resistance to tampering by shattering or cutting/twisting methods.

BRIEF DESCRIPTION OF THE DRAWINGS

A more complete understanding of the present invention and attendant advantages and features thereof will be more readily understood by reference to the following detailed description when considered in conjunction with the accompanying drawings wherein.

DETAILED DESCRIPTION OF THE INVENTION

Figure 1:
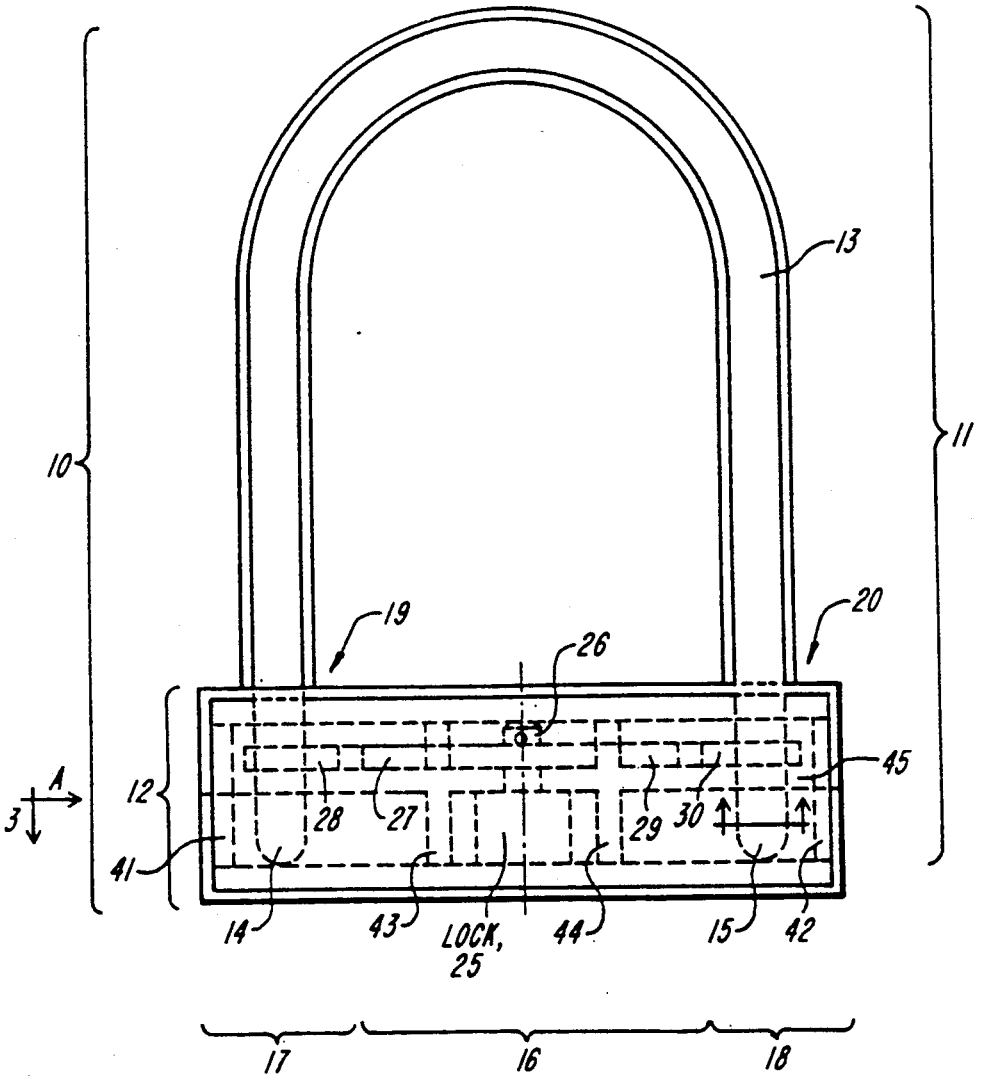
FIG. 1 is front plan view of the U-shaped lock of the invention.

Reference is made to the drawings wherein like numerals designate corresponding or similar elements throughout the several views. There is shown in FIG. 1 an exemplary embodiment of the U-shaped lock 10 of the invention which is comprised of a U-shaped body 11 and a transverse housing 12 mated together. The shackle 11 is comprised of a U-shaped body portion 13 which is generally extended so as to permit the lock to be used with large or spaced objects, such as bicycle or motorcycle frames and wheels. The U-shaped body portion 13 has a first longitudinal extending end 14 and a second longitudinal extending end 15. The first extending end 14 has a perpendicularly disposed receptacle channel 32. The second extending end 15 similarly has a perpendicularly disposed receptacle channel 34. In an exemplary embodiment of the invention, the channels 32/34 run through the entire diameter or width of the shackle extending ends 14/15.

The shackle 11, shackle body 13, and extending ends 14/15 may be formed in any cross-sectional shape or shapes. A preferred tubular form is shown in FIG. 1. The shackle 11 is preferably made of hard material such as metal, and should be made substantially thick to resist cutting and sawing. The design of the invention permits thick material to be used efficiently in the areas which most require structural integrity.

A transverse housing 12 which lockably mates to the shackle 11 is comprised of a transverse body portion 16, a first end 14 having an opening or receptacle 19 for receiving one of the longitudinal extending ends 14 of the shackle 11, and a second end 15 having an opening or receptacle 20 for receiving the other of the longitudinal extending ends 15 of the shackle 11. The transverse housing 12 is preferably formed of hard material, such as material, in generally tubular form. It should be substantially thick to resist tampering such as by shattering or cutting.

The transverse housing 12 may be made of solid material which is drilled out to permit installation of a lock assembly and to permit lockable mating with the shackle. Alternatively, the transverse housing may be made out of a thick tube, as shown in FIG. 1, with an internal matrix shown generally at 41–45 to provide structural integrity. In an exemplary embodiment of the invention, solid end pieces 41 and 42 may be welded, glued, or otherwise affixed to the ends 17 and 18 of the tubular housing 12. A matrix, such as one having members 43 and 44, may be fixed within the intermediate housing portion 16 to provide further structural rigidity. A longitudinal matrix or brace member 45 can be fixed along the length of the transverse housing 12 so as to provide further rigidity and structural integrity as well as to provide a framework for mounting the locking mechanism as will be hereinafter described.

A lock 25 is located within the intermediate portion 16 of the transverse housing 12 between the receptacle openings 19 and 20. The lock 25 may be of the key-actuated type or the combination type known in the art, or of any other kind of mechanism which can fit within the dimensions of the housing 12. Connected to the lock 25 within the housing 12 is an actuator 26 which moves in response to the actuation of the lock 25 and in turn moves post members 27 and 29. Each of the post members 27 and 29 are connected to the actuator 26 and have longitudinal extending ends 28 and 30 conformed to fit into the receptacle channels 32 and 34 of the shackle ends 14 and 15 when the shackle 11 is mated to the housing 12. Preferably, the post member elongated ends 28 and 30 extend through the shackle end receptacle channels 19 and 20 when the lock 26 is actuated.

Figure 1A:
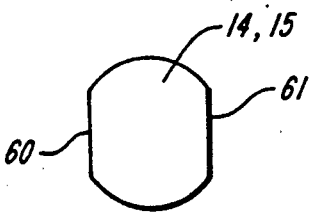
FIG. 1A is a cross-sectional view as indicated at C in FIG. 1 of a shackle end of an embodiment of the invention.

FIG. 1A, which is a view along C of FIG. 1, shows an exemplary embodiment of the invention in which the extended ends 14/15 of the shackle 11 have flat portions 60 and 61 which correspond with flat portions (not shown) in the corresponding openings 19/20 in the housing 12 to further prevent the shackle 11 from being rotated if it is cut. The flat sections 60 and 61 are preferably perpendicular to the direction in which the post members 28 and 30 intersect the shackle ends 14 and 15.

Figure 2:
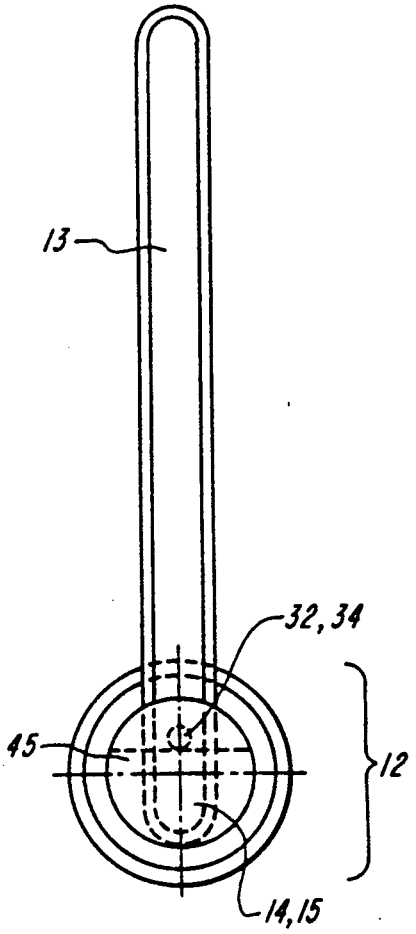
FIG. 2 is a view of the lock of FIG. 1 along direction A.

FIG. 2 shows the exemplary embodiment of the invention along direction A of FIG. 1. The longitudinal extending ends 14 and 15 of the shackle need not extend entirely through the body of the housing 12; the housing 12 therefore does not require a second set of openings. A flat longitudinal brace bar or matrix 45 may be fixed inside the housing 12 to provide structural support. The receptacle channels 32/34 of the shackle 11 are generally parallel to the axis of the transverse housing 12 in the tubular embodiment shown.

Figure 3:
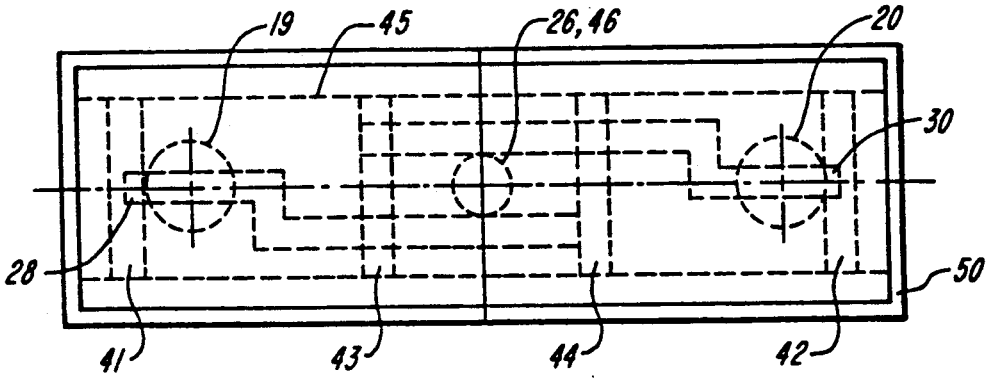
FIG. 3 is a view of the lock of FIG. 1 along direction B.

FIG. 3 shows a view of the lock along direction B of FIG. 1. Thus, in an exemplary embodiment of the invention, the housing 12 can be made with a relative minimum of internal parts and yet afford structural integrity and resistance to tampering and breakage. For example, matrix portions 43 and 44 may contain channels (not numbered) to hold and permit the slideable passage of the locking posts 27 and 29 so that their respective extended ends 28 and 30 are aligned with the receptacle channels 19 and 20 of the shackle ends 14 and 15. In addition, the end pieces 28 and 30 may contain further receptacle holes (not numbered) for receiving the locking post extending ends 28 and 30 for further protection against defeat of the lock by shattering of the shackle and twisting of the shackle ends 14 and 15. The end pieces 28 and 30 may be sunk into the tubular housing 12 so that they are less susceptible to tampering.

The locking mechanism which comprises the lock 25, actuator 26, and post members 27/28 and 29/30 may include a variety of mechanisms which result in the lockable engagement of the shackle ends. For example, the actuator 26 may be a pinion which engages racks on the post members 27 and 28 in the manner of a car steering mechanism. Thus, when the actuator is turned in one direction, both post members 27/28 are moved outwardly to engage with the receptacle openings 32/34 of the shackle ends 14 and 15. When the actuator is turned in the other direction, both post members are retracted to permit removal of the shackle.

Figure 4:
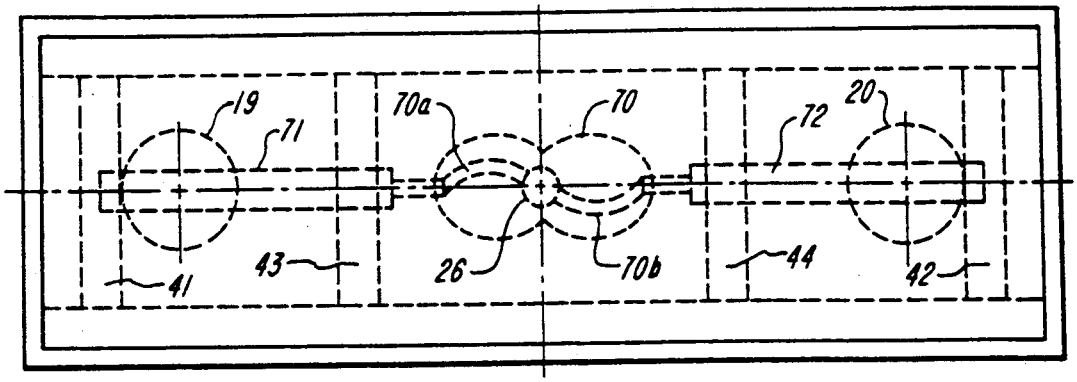
FIG. 4 is a top plan view of a housing having a cam and pin assembly.
Figure 5:
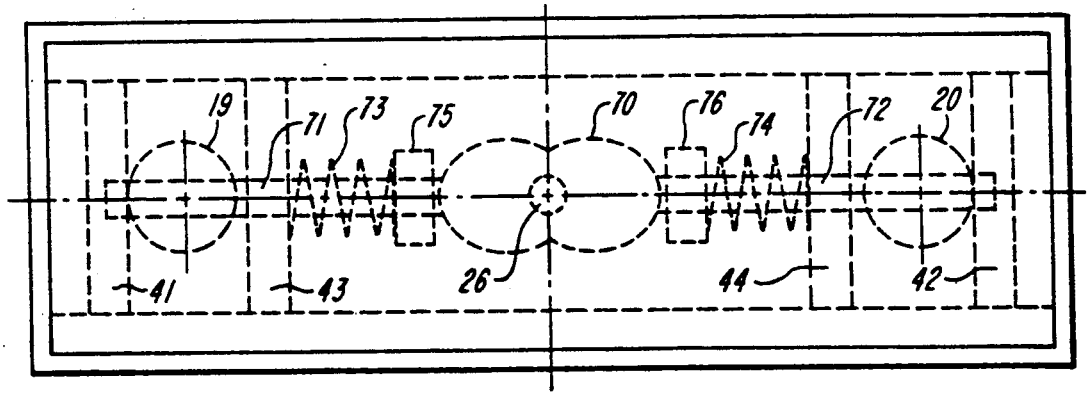
FIG. 5 is a top plan view of a housing having a cam and pin assembly with springs.

Alternatively, as shown in FIG. 4, the actuator 26 may be connected to a cam 70 having tracking grooves **70*a* and 70*b* for radially engaging pushrods or captive pins 71 and 72 and moving them inwardly and outwardly. The pins 71 and 72 may contain members which travel along grooves 70*a* and 70*b* so that the pins may thereby be pushed into and pulled from shackle ends located in the housing openings 19 and 20 when the cam is turned by the lock 25. FIG. 5 shows a further embodiment of the invention wherein a cam-and-pin assembly comprises a cam 70 which, when turned by the actuator 26, engages pins 71 and 72, pin heads 75 and 76 which directly contact the cam 70, and springs located between the pin heads 75 and 76 and matrix portion 43 and 44 to bias the pins 71 and 72 away from shackle ends 19 and 20** when the cam is returned to its original position.

In another embodiment of the invention, fork members which grip external flat portions located on the shackle ends may be used instead of the post members which intersect the shackle ends. The engagement between the flat portions and fork members would also prevent twisting of a shackle in the housing opening in the event that the shackle was cut.

In addition to the rack-and-pinion, cam-and-pinion, post member, and fork members assemblies described above, other mechanisms which permit both shackle ends to be lockably secured within the housing are contemplated within the scope of the invention. The invention permits the lock to be accessible from any direction desired on the radial surface of the intermediate housing portion. For example, the lock could be disposed through an opening 46 towards the U-shaped shackle to provide further protection against direct blows of a hammer or other striking implements so as to resist shattering. The housing may be encased in a layer of protective material 50 such as plastic or rubber to enhance durability and provide insulation and additional hindrance to tampering.

A variety of modifications and variations of the present invention are possible in light of the above teachings. It is therefore to be understood that, within the scope of the appended claims, the present invention may be practiced otherwise than as specifically described hereinabove.

What is claimed is:

1. A U-shaped lock comprising:

a shackle having a generally U-shaped extended body portion with first and second longitudinal extending ends, each of said longitudinal extending ends having a channel disposed orthogonally through said end;

a transverse housing for lockable mating with said shackle ends, said housing comprising a transverse body portion, a first end having an opening for receiving one of said shackle ends, and a second end having an opening for receiving the other of said shackle ends;

a lock cylinder located intermediate within said transverse housing between said openings of said first and second housing ends, said lock cylinder having actuated and unactuated states;

a first actuatable locking member located intermediate within said transverse body portion of said housing between said first and second housing ends, said first locking member having an extended portion and a longitudinal extending end, said extending end operative to pass through said channel of said first shackle end when said shackle is mated to said housing and said lock cylinder is actuated;

a second actuatable locking member located intermediate within said transverse body portion of said housing between said first and second housing ends, said second locking member having an extended portion and a longitudinal extending end, said extending end operative to pass through said channel of said second shackle end when said shackle is mated to said housing and said lock cylinder is actuated;

and an actuator located intermediate within said housing portion between said openings of said first and second ends, said actuator connected to said lock cylinder and to said first and second actuatable locking members, whereby each of said extending ends of said first and second locking members engages with said first and second shackle extending ends when said shackle is mated to said housing and said lock cylinder is actuated;

wherein said actuator and actuatable locking members are further comprised of a rack and pinion assembly.

2. The lock of claim 1 wherein the cross-sectional shape of said U-shaped shackle and elongated housing is generally tubular.

3. The lock of claim 1 wherein said lock requires a key to change said lock between actuated and unactuated states.

4. The lock of claim 1 wherein said shackle and elongated housing are made of metal.

5. The lock of claim 1 wherein at least one of said actuatable locking members further comprises a post for insertion through one of said shackle ends.

6. The lock of claim 1 wherein said actuator and actuatable locking members further comprise a pin assembly.

7. The lock of claim 1 wherein said actuator and actuator locking members are further comprised of a rotatable member with grooves and pin members having portions conformed for slidably engagement with said grooves, whereby the pin members may be inserted into and extracted from said shackle ends when said actuator is turned.

8. The lock of claim 1 wherein said actuator and actuatable locking members further comprise at least two pins which are movable and which are conformed to slidably engage said shackle ends.

9. The lock of claim 1 wherein said housing further comprises end pieces fixed at said ends of the housing.

10. The lock of claim 1 wherein said housing further comprises an internal matrix for structural bracing of said housing.

11. The lock of claim 10 wherein said matrix contains channels for slideably mounting said locking members and aligning said members to slidably engage with said channels of said shackle ends when said shackle is mated to said housing.

12. A U-shaped lock comprising:

a U-shaped shackle having first and second extended ends each having at least one generally transverse lock channel which permits a bar to be inserted completely through the extended end;

a transverse housing having first and second ends each having a receptacle opening corresponding to and alignable with said shackle extending ends for lockable mating therewith, said transverse housing having an intermediate portion located between said ends;

an actuatable lock cylinder located within said transverse housing intermediate portion;

a pinion gear connecting to said lock cylinder, said gear having teeth for engaging cooperative rack gear teeth;

a pair of bar mechanisms located within said transverse housing intermediate portion and connected to said actuatable lock cylinder for movement in response to actuation of said lock, each of said bar mechanisms having rack gear teeth cooperative with said pinion gear teeth and operative to permit movement of each bar mechanism in a direction opposite to the other and each being configured to be inserted completely through a corresponding one of said at least one generally transverse lock channel of a shackle extended end when said shackle is mated to said transverse housing and said lock cylinder is actuated.

13. The lock of claim 12 wherein said housing further comprises an internal matrix for structural bracing of said housing.

14. A U-shaped lock comprising:

a U-shaped shackle having first and second extended ends each having at least two opposing flat portions;

a transverse housing having first and second ends each having a receptacle opening corresponding to and alignable with said shackle extending ends for lockable mating therewith, said transverse housing having an intermediate portion located between said ends;

an actuatable lock cylinder located within said transverse housing intermediate portion;

a pinion gear connected to said actuatable locking cylinder and having teeth operative to permit engagement with cooperative rack gear teeth;

a pair of fork-shaped members conformed for locking engagement with said opposed flat portions on said U-shaped shackle, said fork-shaped members located within said transverse housing intermediate portion and having rack gear teeth cooperative with said pinion gear teeth and operative to permit said fork-shaped members to be actuated in response to actuation of said lock cylinder, each of said fork-shaped members actuatable in a direction opposite to the other and each being configured to lockably engage a corresponding one of said at least two opposing flat sections located on one of said shackle extended ends when said shackle is mated to said transverse housing and said cylinder is actuated.

* * * * *

UNITED STATES PATENT AND TRADEMARK OFFICE

CERTIFICATE OF CORRECTION

PATENT NO. : 5,101,646

DATED : April 7, 1992

INVENTOR(S) : David S. Goldman, et al.

It is certified that error appears in the above—identified patent and that said Letters Patent is hereby corrected as shown below:

Column 1, line 27, "removeably" should read --removably--.

Column 3, line 1, "material" should read --metal--.

Column 5, line 59, "slidably" should read --slidable--.

Column 6, line 67, "said cylinder" should read --said lock cylinder--.

Signed and Sealed this

Sixteenth Day of November, 1993

Bruce Lehman

*Attest:*

BRUCE LEHMAN

*Attesting Officer*

*Commissioner of Patents and Trademarks*